US005103969A

United States Patent [19]

Tarozzi

[11] Patent Number: 5,103,969

[45] Date of Patent: Apr. 14, 1992

[54] PORTABLE TRAY HAVING A MOVABLE HANDLE

[75] Inventor: Richard A. Tarozzi, Gales Ferry, Conn.

[73] Assignee: Binney & Smith, Easton, Pa.

[21] Appl. No.: 661,689

[22] Filed: Feb. 26, 1991

[51] Int. Cl.[5] ..... B65D 25/28; B05C 17/00; B44D 3/04

[52] U.S. Cl. ..... 206/1.7; 206/1.8; 220/550; 220/94 R; 229/117.22

[58] Field of Search ..... 220/95 R, 550; 206/1.8, 206/1.7, 564; 229/117.22

[56] References Cited

U.S. PATENT DOCUMENTS

| | | | |
|---|---|---|---|
| 307,768 | 11/1884 | Heysinger . | |
| 424,603 | 4/1890 | Favor . | |
| 468,639 | 2/1892 | Bryant . | |
| 617,406 | 1/1899 | Pinchin . | |
| 1,757,475 | 5/1930 | Pratt | 220/94 R |
| 2,323,094 | 6/1943 | Levin | 220/94 R |
| 2,458,133 | 1/1949 | Behrens . | |
| 2,460,915 | 2/1949 | Allen . | |
| 2,740,517 | 4/1956 | Evans . | |
| 2,777,597 | 1/1957 | Ruff . | |
| 2,826,332 | 3/1958 | Hudson | 229/117.22 |
| 3,025,996 | 3/1962 | Habicht et al. . | |
| 3,167,808 | 2/1965 | Lindberg et al. . | |
| 3,273,700 | 9/1966 | Moreau et al. . | |
| 3,281,010 | 10/1966 | Moore et al. . | |
| 3,339,796 | 9/1967 | Struble . | |
| 3,372,700 | 9/1966 | Moreau et al. . | |
| 3,734,336 | 5/1973 | Rankow et al. . | |
| 3,891,084 | 6/1975 | Garcia . | |
| 4,058,210 | 11/1977 | Mitchell . | |
| 4,294,348 | 10/1981 | Hastings . | |
| 4,714,158 | 12/1987 | Oltman et al. | 220/94 R |
| 4,720,021 | 1/1988 | Byrns | 220/94 R |
| 4,901,846 | 2/1990 | Lehman . | |
| 4,991,711 | 2/1991 | Cheng | 220/94 R |

FOREIGN PATENT DOCUMENTS

| | | | |
|---|---|---|---|
| 2110637 | 6/1983 | United Kingdom | 220/94 R |

*Primary Examiner*—William I. Price

*Attorney, Agent, or Firm*—Neuman, Williams, Anderson & Olson

[57] ABSTRACT

The present invention is an apparatus comprising a portable object, a longitudinally disposed carrying handle for the portable object having first and second ends, and first and second handle retaining means. More particularly, the apparatus can be a paint container tray which is provided with compartments suitably sized for artist's supplies. When the tray is in use by an artist, the handle may be lowered to a stowed position allowing the artist full and simple access to the entire paint container tray. When the handle is raised into the use position, it can optionally be held in that position by friction.

19 Claims, 2 Drawing Sheets

PORTABLE TRAY HAVING A MOVABLE HANDLE

FIELD OF THE INVENTION

This invention relates to a portable apparatus having a movable handle, and more particularly to portable paint container carrying trays having movable handles and adapted for use by children.

BACKGROUND OF THE INVENTION

Artists generally collect kits of art supplies such as variously colored paints in bottles, tubes or watercolor pan paint pallets, as well as painting and drawing instruments and carrying containers. Children most often work with commercially available bottled paints and watercolor pan paint pallets. These supplies are provided in standard sizes by many manufacturers. Children especially make use of such paints in school and extracurricular art classes. While adults are generally able to cope with myriad supplies, children often find difficulty in organizing and using such supplies without spilling them. While carrying trays for such supplies have been devised, they often are difficult to use or have tops or handles which inhibit access to the paint containers. Typically, these trays are solely made for transporting the paints, which must then be removed from the trays for use by the artist.

Artists also often mix various colors of paints to obtain an exact hue or tint. Adults do such mixing on paint mixing boards. However, children, unaccustomed to such messy procedures, often mix colors directly on a desk top or on a piece of paper which bleeds through onto a desk top.

After completing a painting, an artist must clean and store a variety of art supplies. After only one or two uses, a conventional artist's pallet is defaced with blended paints and smears which cannot be cleaned. For children, the chore of cleaning up after painting is heightened when they have smeared paint on a school desk or kitchen table. A paint container tray for use by children should be easily cleanable by a child with a minimum of supervision.

Finally, artists are often at a loss as to where to place their paint brushes when they have finished painting for the day. Children especially are faced with a lack of convenient storage locations for their paint brushes, as their brushes often come in shrink-wrapped packages which cannot be reused once they are opened. For this reason, children often misplace their brushes or place brushes in their school desks where the brushes can be damaged by the constant movement of books into and out of the desk. Additionally, when a brush is cleaned immediately after use, the brush remains wet with either water or paint thinner for some time, and this wet brush cannot be placed in a desk or laid down on any good surface.

OBJECTS OF THE INVENTION

It is therefore an object of the invention to provide a portable article having a stowable carrying handle.

A further objective is to provide a paint container tray which is useful in organizing various commercially available artist's paint containers and other art supplies.

Another object of the invention is a paint container tray which prevents the spilling of various commercially available artist's paint containers.

An added object of the invention is to provide a paint container tray with a movable handle which allows for easy carrying while at the same time being stowable to allow easy access to all paint containers placed on the paint container tray.

A further object of the invention is to provide a useful and convenient area on a tray to easily mix various paint colors to form unique colors without spilling paint or defacing the work surface.

Additionally, an object of the invention is to provide a paint container tray which is easily cleaned following use.

SUMMARY OF THE INVENTION

These and other goals are achieved by the present invention which comprises a portable object, a longitudinally disposed carrying handle for the portable object having first and second ends, and first and second handle retaining means.

The handle-retaining means include upstanding first and second facing walls which have proximal ends secured to the portable object and distal ends extending away from the object. The facing walls are spaced at least far enough apart that the handle can be slid between a stowed position with the ends of the handle between the proximal ends of the walls and a use position with the ends of the handle between the distal ends of the walls. Each of the facing walls may be separated into two segments by a slot extending substantially from the proximal end to the distal end of the wall.

The apparatus of invention may also have capturing means disposed inboard of the facing walls for stopping further distal travel of the handle when the handle is in the use position. The apparatus of the invention may also have guide means disposed inboard of the facing walls for normally confining the handle to substantially distal and proximal travel between the walls.

Such an apparatus is especially useful when the portable object is a tray having a carrying surface. In the preferred form of the invention, the carrying surface has compartments. The compartments may be adapted to accommodate bottles, pan paint pallets, or drawing instruments. The carrying surface may also include compartments adapted to contain a small amount of a fluid paint for mixing. Additionally, the compartments for drawing instruments preferably have recesses to enable easier access to drawing instruments contained in the compartment. To accommodate the handle when it is not in the use position, the carrying surface may also have a compartment adapted to accommodate the carrying handle.

DETAILED DESCRIPTION OF THE PREFERRED EMBODIMENT

Figure 1:
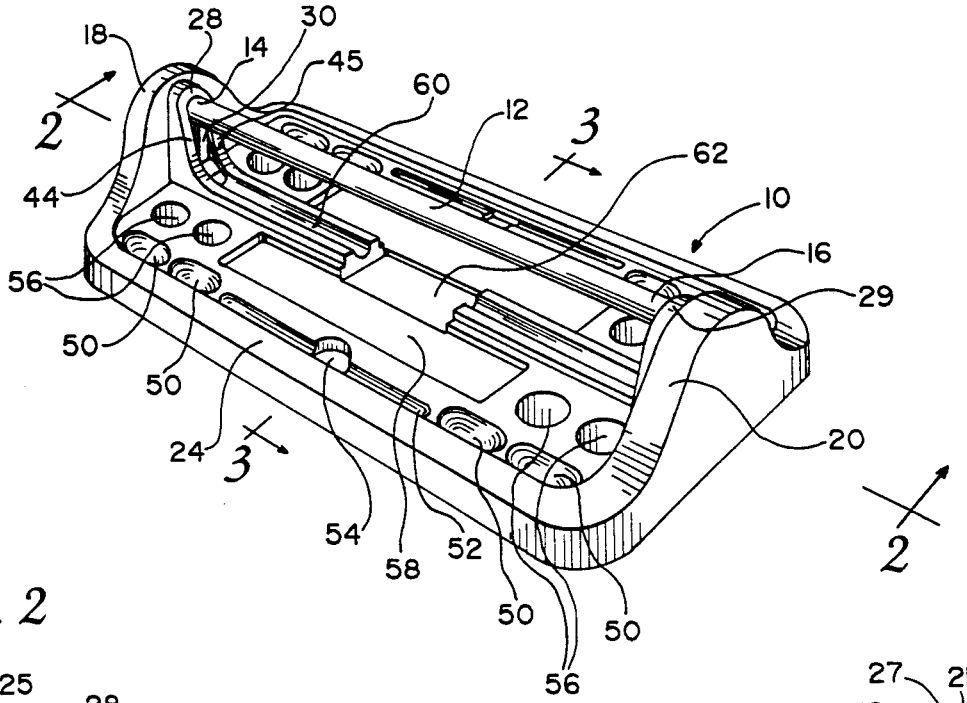
FIG. 1 is a perspective view of the preferred embodiment of a paint container tray with the movable handle in the carrying position.
Figure 2:
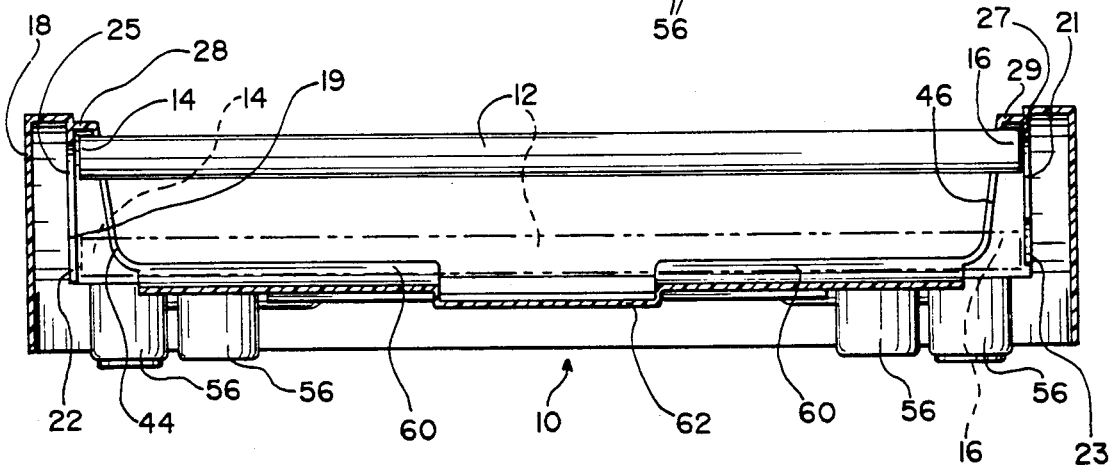
FIG. 2 is a section taken along line 2—2 of FIG. 1. The handle in full lines is in its use position; the handle in phantom is in the stored position.
Figure 3:
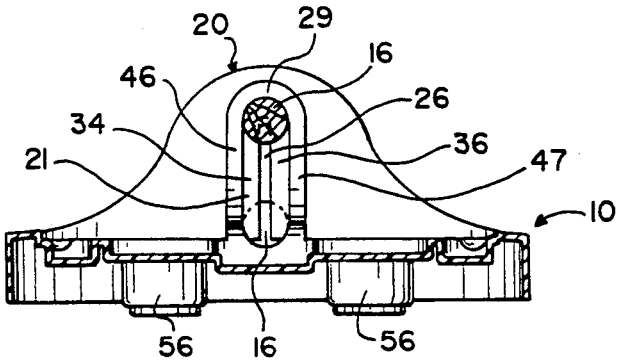
FIG. 3 is a section taken along line 3—3 of FIG. 1.

Referring now to the drawings, wherein like reference numerals designate identical or corresponding parts throughout the several views, FIGS. 1–3 show one embodiment of an apparatus of the invention. This apparatus is a paint container tray assembly 10 having a carrying handle 12 with a first end 14 and a second end 16, a first handle retaining means 18, a second handle retaining means 20, and a carrying surface 24.

The handle retaining means 18 and 20, respectively, include facing walls 19 and 21 which are spaced at least far enough apart that the handle 12 can be slid between a stowed position (the position of the end 16 shown in phantom lines in FIG. 3) and a use position (the position of the end 16 shown in full lines in FIG. 3). In the stowed position of the handle 12, the ends 14 and 16 are between the proximal ends 22 and 23 of the facing walls 19 and 21. In the use position of the handle 12, its ends 14 and 16 are between the distal ends 25 and 27. In the preferred embodiment, the handle 12 is freely movable from the stowed position to the use position and upon release from the use position, immediately moves to the stored position due to gravity. Alternatively, the handle 12 may be frictionally lodged but slidable between the facing walls 19 and 21.

Figure 4:
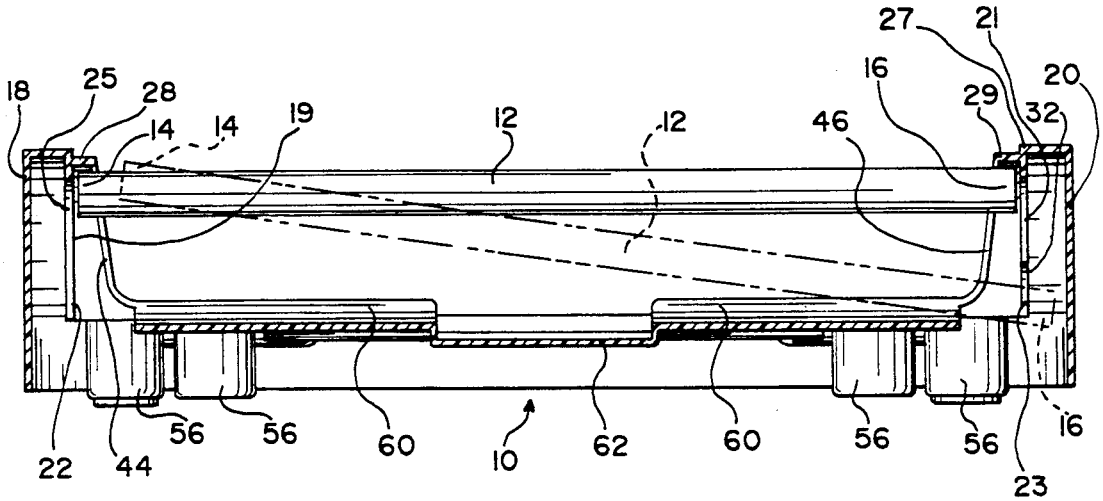
FIG. 4 is a section similar to FIG. 2 showing a second embodiment. The handle in full lines is in its use position; the handle in phantom is partially removed.
Figure 5:
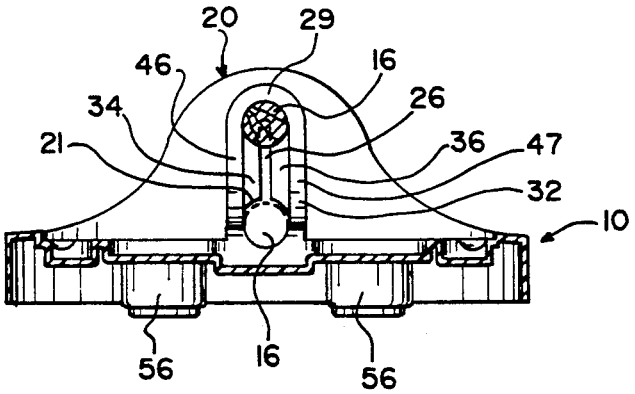
FIG. 5 is a section similar to FIG. 3 of the second embodiment.

Each of the facing walls 19 and 21, for example the wall 19, may be separated into two segments 34 and 36 by a slot 26. The slot 26 extends substantially from the distal end 25 to the proximal end 22 of the wall 19. In the embodiment illustrated by FIGS. 1–3, the facing walls 19 and 21, each separated by a slot 26, are identical. In FIGS. 4–5, an alternate embodiment of facing walls 19 and 21 is illustrated and will be addressed later.

The apparatus 10 also has capturing means 28 and 29, respectively, located inboard of the facing walls 19 and 21. (This relationship is seen particularly in FIG. 2.) These capturing means 28 and 29 prevent further distal travel of the handle 12 when the handle is in the use position. The handle retaining means 18 and 20 also have side edges 44, 45, 46, and 47 defining opposed vertically oriented slots. These edges function as guide means, disposed inboard of the facing walls 19 and 21 for normally confining the handle 12 to substantially distal and proximal travel between the handle retaining means 18 and 20.

In one embodiment of the invention, the length of the handle 12 is less than the distance between the walls 19 and 21. When the tray is upright, the handle will automatically drop by gravity to its proximal or stowed position, except when the tray is carried by its handle. In the latter case, the capturing means 28 and 29 rest on and are supported by the ends 14 and 16 of the handle 12.

In another embodiment of the invention, the length of the handle 12 is about as great as the distance between the walls 19 and 21, so the handle is slidable between its stowed and distal positions but remains lodged between the walls 19 and 21 when in its distal position. The force to dislodge the handle 12 from its distal position is thus greater than the force gravity exerts on the handle.

Insertion of the handle 12 into the tray 10 can be facilitated in various ways. In the preferred embodiment, the tray 10 can be made of resilient material so that the handle retaining means 18 and 20 can be flexed apart, allowing insertion of the handle 12. The handle 12 may also be made of resilient material so that it can be flexed and its ends 14 and 16 inserted in the handle retaining means 18 and 20.

FIGS. 4–5 illustrate a second embodiment of the invention which provides a means of inserting the handle 12 into the handle retaining means 18 and 20 without flexing the tray 10 or the handle 12. The paint container tray 10 is provided with an aperture 32 through the wall 21 to enable removal of the handle 12. The aperture 32 is sized to pass the first end 16 of the handle 12, as seen in phantom view in FIGS. 4 and 5. The facing wall 19 is formed as seen in FIG. 3, and does not require an aperture such as 32. The second end 14 of the handle 12 can be freed from the capturing means 28 and the guide means 30 by moving it laterally (i.e. upward or to either side) while the first end 16 of the handle 12 is inserted into the aperture 32. After the second end 14 is free, the first end 16 can be withdrawn longitudinally from the aperture 32, the capturing means 28 and the guide means 30 to free the handle 12 from the handle-retaining means 18 and 20.

The tray 40 has a carrying surface 42 which may have a plurality of variously configured compartments 50, 52, 54, 56, and 58. Each mixing compartment 50 is configured to permit the mixing of various commercially available paint colors to obtain a desired customized color for use by the artist. A mixing compartment 50 is preferably configured to allow mixing of a considerable amount of paint without the fear of spilling paint onto the work area lying underneath the paint container tray. The provision of mixing compartments 50 encourages children not to perform such mixing operations on a desk or table top.

In the preferred embodiment of the invention, the mixing compartment 50 is about 1.5 inches (3.8 centimeters) in length, about 0.6 inches (1.3 centimeters) in width, is curved on either end on about a 0.4 inch (1.0 centimeter) radius and has an arcuate bottom with a maximum depth of about 0.3 inches (0.8 centimeters) being constructed on about a 0.4 inch (1.0 centimeter) radius. The curved bottom and ends of each mixing compartment 50 allow for maximum drainage of the paint to the bottom of the compartment with little adherence of paint to the compartment walls.

The absence of square corners which may trap paint in the mixing compartments 50 allows easy clean-up. Ease of clean-up is especially important in paint container trays used by children. In the embodiment of the invention described here, there are eight of the mixing compartments 50.

The drawing instrument compartments 52 are adapted to permit the storage of artists' drawing instruments such as paint brushes, drawing pens or pencils. In the preferred embodiment of the invention, the drawing instrument compartment 52 accommodates at least one paint brush, drawing pen or pencil and is about 7 inches (17.8 centimeters) in length, about 0.4 inches (1.0 centimeters) in width, and has a maximum depth of about 0.3 inches (0.8 centimeters) being constructed on about a 0.2 inch (0.5 centimeter) radius. The ends of each drawing instrument compartment 52 are also curved, so no square corners are created. Again, the absence of square corners eases clean-up.

A freshly cleaned, wet brush can be placed in a drawing instrument compartment 52 and the brush can drain and dry by evaporation without soiling or damaging the table or other work surface. In the preferred embodiment of the invention, there are two drawing instrument compartments 52.

Each drawing instrument compartment 52 is preferably constructed with a recess 54. This recess 54 is sized to receive an adult's or child's finger to allow him or her to grasp a drawing instrument contained in the compartment 52.

In the preferred embodiment of the invention, the recess 54 is configured as a half circle and has about a 0.5 inch (1.3 centimeter) radius extending from one side of the drawing instrument compartment 52. The finger recess 54 has a depth of about 0.4 inches (1.0 centimeters), which is slightly deeper than the drawing instrument compartment 52. This increased depth allows a child or adult to insert a finger into the recess 54, curl the finger under the drawing instrument contained in the drawing instrument compartment 52, and easily lift out the drawing instrument.

The bottle compartments 56 are constructed to receive the storage bottles in which such fluids as paints and drawing inks are sold. In this instance, each compartment 56 is designed to contain a bottle of Crayola® poster paint, manufactured and sold by Binney & Smith, Inc., Easton, Pa.

The bottle compartment 56 enables an artist to place a bottle in the compartment, remove the cap from the bottle, and use the contents of the bottle without the worry of striking the bottle and knocking it over or having the bottle slide off of the work surface and spill. This ability is especially important when the user is a child. In the preferred embodiment of the invention, the bottle compartment 56 is cylindrical, about 1.2 inches (3.1 centimeters) in diameter and about 1.1 inches (2.8 centimeters) is depth. The preferred embodiment of the invention contains eight bottle compartments 56.

The pan paint pallet compartment 58 is constructed to receive a typical artist's water color pan paint pallet such as a Crayola® eight-pan paint pallet, manufactured and sold by Binney & Smith, Inc., Easton, Pa. Artists often wish to use bottle paints and traditional water color paints together while working on a single project. The carrying surface of the invention enables an artist to carry and work with these two paint media, stored and used on the same tray.

In the preferred embodiment of the invention, the pan paint pallet compartment 58 is rectangular and about 8.5 inches (21.6 centimeters) in length, about 1.6 inches (4.1 centimeters) in which, and about 0.3 inches (0.8 centimeters) in depth. Further, in the preferred embodiment of the invention there are two pallet compartments 58.

The handle storage compartments 60 are constructed to permit the storage of the handle 12 when the apparatus 10 is used by the artist. The storage compartments 60 extend from and are integral with each guide means 30. The storage compartments 60 extend from the handle retaining means 18 and 20 and each terminates in a grasping area 62 so one's fingers may be inserted into the grasping area 62 beneath a stored handle 12 and the handle 12 may be raised to the use position.

The storage compartments 60 and the edges 44, 45, 46, and 47 ensure that the handle will not swing laterally into the various items held by the paint container tray 10. Additionally, the ability to stow handle 12 against the carrying surface 24 allows the artist full access to all of the items contained on the paint container tray 10 without having to reach over, under or around the handle 12.

The carrying surface 24 and the handle retaining means 18 and 20 are preferably constructed in one piece. One-piece construction ensures that there are no crevices between abutting parts creating difficult to clean areas in which paint may lodge. One-piece construction also ensures that the paint container tray cannot be dismantled and parts misplaced. Furthermore, no worries are created about the size of pieces and the possible ingestion of the pieces by a child.

Plastic is also preferred as the construction material of the paint container tray, as one-piece plastic construction presents an easy to construct, easy to clean surface. A one-piece plastic paint container tray may be molded using a two-part mold. When a flexible material is used in the construction of the invention, the embodiment illustrated in FIGS. 1–3 may be used and the resulting one-piece construction may be flexed to enable insertion of the handle into the handle retaining means 18 and 20, the capturing means 28 and 29, and the side edges 44, 45, 46, and 47. Where a very stiff material is used in the construction of the invention, the embodiment illustrated in FIGS. 4–5 may be used to allow insertion of the handle 12 into the one-piece construction.

The handle 12 is most easily made from a wooden dowel, but may also be made of plastic or any other hard, stiff material. Further, in the preferred embodiment of the invention, all compartments 50, 52, 56, 58, and 60 are evenly spaced on the carrying surface 24 so the tray is evenly balanced and will not tip when the paint container tray is lifted by the handle 12. Also, compartments constructed to contain heavier items, such as the bottle compartments 56, are located more centrally on the carrying surface 24 to ensure proper balance.

While particular embodiments and applications of the present invention have been shown, it will be understood that the invention is not limited thereto. Modifications may be made by those skilled in the art, particularly in light of the foregoing teachings. Therefore, the appended claims are intended to cover any such modifications as incorporate those features or come within the true spirit and scope of the invention.

What is claimed is:

1. An apparatus comprising:

a. a portable object;

b. a longitudinally disposed carrying handle for said portable object having first and second ends; and c. first and second handle retaining means, said handle-retaining means including upstanding, first and second facing walls having proximal ends secured to said portable object and distal ends extending away from said object, said walls being spaced at least far enough apart that said handle can be slid from a stowed position with the ends of said handle between said proximal ends to a use position with the ends of said handle between said distal ends.

2. An apparatus according to claim 1, wherein said portable object comprises a tray having a carrying surface.

3. An apparatus according to claim 1, further comprising capturing means disposed inboard of said facing walls for stopping further distal travel of said handle when said handle is in said use position.

4. An apparatus according to claim 1, further comprising guide means disposed inboard of said facing walls for normally confining said handle to substantially distal and proximal travel between said walls.

5. An apparatus according to claim 4, further comprising capturing means disposed inboard of said facing walls for stopping distal travel of said handle beyond said use position.

6. The apparatus of claim 5, said first wall having an aperture formed therein and adapted to receive said first end of said handle, thereby permitting said second end of said handle to be freed from said guide means and said capturing means by a lateral movement of said second end when the first end of said handle is received in said aperture, and then permitting said first end of said handle to be withdrawn longitudinally from said aperture, said guide means, and said capturing means to free said handle from said handle-retaining means.

7. An apparatus according to claim 2 wherein said carrying surface further comprises a plurality of compartments.

8. An apparatus according to claim 7 having at least one of said plurality of compartments adapted to accommodate a bottle.

9. An apparatus according to claim 7 having at least one of said plurality of compartments adapted to accommodate a pan paint pallet.

10. An apparatus according to claim 7 having at least one of said compartments adapted to accommodate at least one drawing instrument.

11. An apparatus according to claim 10 wherein said compartment has a recess formed in at least one wall thereof, said recess being adapted to facilitate grasping a drawing instrument contained in said compartment.

12. An apparatus according to claim 7 having at least one of said plurality of compartments adapted to contain a small amount of a fluid paint for mixing.

13. An apparatus according to claim 7 having at least one of said plurality of compartments adapted to accommodate said carrying handle for storage.

14. An apparatus according to claim 1 wherein each said facing wall is separated into two segments by a slot, each slot extending substantially from the proximal end to the distal end of the corresponding wall.

15. An apparatus according to claim 1, wherein said portable object and said first and second handle retaining means are of one-piece, integrally molded construction.

16. An apparatus according to claim 15, wherein said portable object comprises a tray having a carrying surface, and wherein said carrying surface has a plurality of compartments formed therein.

17. An apparatus according to claim 10 wherein said at least one compartment adapted to accommodate at least one drawing instrument has substantially smooth, arcuate sides and bottom.

18. An apparatus according to claim 10 wherein said at least one compartment adapted to retain paint for mixing has substantially smooth, arcuate sides and bottom.

19. An apparatus according to claim 1 wherein said portable object and said first and second handle retaining means are resilient, whereby said handle retaining means can be flexed apart sufficiently to allow insertion of said handle into said handle retaining means.

* * * * *